US005425886A

United States Patent [19]

Smith

[11] Patent Number: 5,425,886

[45] Date of Patent: Jun. 20, 1995

[54] ON DEMAND, NON-HALON, FIRE EXTINGUISHING SYSTEMS

[75] Inventor: Benjamin D. Smith, Colonial Beach, Va.

[73] Assignee: The United States of America as represented by the Secretary of the Navy, Washington, D.C.

[21] Appl. No.: 83,403

[22] Filed: Jun. 23, 1993

[51] Int. Cl.[6] ..... A62D 1/06

[52] U.S. Cl. ..... 252/5; 252/4; 252/601; 169/66; 169/12; 169/45; 169/46; 149/36; 149/46

[58] Field of Search ..... 252/2, 4, 5, 6, 601; 169/66, 68, 12, 84, 46, 28; 149/36, 46

[56] References Cited

U.S. PATENT DOCUMENTS

| | | | |
|---|---|---|---|
| 3,390,029 | 6/1968 | Preckel | 149/41 |
| 3,719,604 | 3/1973 | Prior et al. | 252/186.1 |
| 3,986,560 | 10/1976 | Heath et al. | 169/61 |
| 4,601,344 | 7/1986 | Reed, Jr. et al. | 169/47 |
| 4,702,322 | 10/1987 | Richardson | 169/28 |
| 4,763,731 | 8/1988 | Adams et al. | 169/46 |
| 4,954,271 | 9/1990 | Green | 252/8 |
| 5,040,611 | 8/1991 | Steel | 169/62 |
| 5,198,046 | 3/1993 | Bucerius et al. | 149/61 |

OTHER PUBLICATIONS

CA:80:49966, *Propellants For the Transport of Liquids*, Bloss, Karl H. (Battelee-Institute, V.).

*Primary Examiner*—Gary Geist
*Assistant Examiner*—Joseph D. Anthony
*Attorney, Agent, or Firm*—James B. Bechtel

[57] ABSTRACT

A system and process for on-demand generation of inert, non-flammable gases and water vapor to decrease the available atmospheric oxygen in the ullage of a hydrocarbon fuel storage tank to a level that will not support combustion of the hydrocarbon fuel, is disclosed. One, or more, of a variety of non-Halon, fire suppressor charges are selectively contained in one or more gas generating cartridges. The gas generating cartridge(s), when activated, cause release of these charges to promote rapid chemical reactions and supply inert, non-flammable gases and water vapor to the tank ullage. Activation is accomplished in aircraft by, either pilot action or, by pressure and temperature sensors contained within the hydrocarbon fuel tank.

4 Claims, 3 Drawing Sheets

ON DEMAND, NON-HALON, FIRE EXTINGUISHING SYSTEMS

ORIGIN OF THE INVENTION

The invention described herein was made by an employee of the United States Government and may be manufactured and used by or for the Government for governmental purposes without the payment of any royalties thereon or therefor.

FIELD OF THE INVENTION

The invention relates to fire extinguishing systems in general, and relates specifically to on demand, gas generator systems for producing inert, non-flammable gases and water vapor that decrease the available atmospheric oxygen to such an extent that burning of hydrocarbon fuels cannot be sustained.

BACKGROUND OF THE INVENTION

Presently, the use of hydrocarbon fuels, such as JP-4, JP-5, diesel and gasoline, in military fixed and rotary wing aircraft, as well as in ship and ground vehicles, is a necessity in the defense of our country. In combat situations, vehicle fuel tanks containing these fuels are frequently exposed to enemy fire, which can cause penetration of the fuel tanks by fragment, ball, Armor Piercing (AP) projectiles, Armor Piercing Incendiary (API) and High Explosive Incendiary (HEI) projectiles. The projectile calibre range from small arms (7.62 and 12.5 mm, as well as 0.30 and 0.50 CAL projectiles) to anti-armor and anti-personnel (12.5, 14.7, and 20 mm projectiles) to anti-aircraft shells, mortar, grenades, and missiles (surface-to-air and air-to-air). The penetration and entry of these projectiles and/or the detonation of the High Explosive (HE) and HEI projectiles and/or their fragments into vehicular, and stationary, hydrocarbon fuel storage tanks can cause the hydrocarbon fuels to ignite and burn.

At present, the most effective gaseous fire extinguishing system available is the HALON class of fire extinguishers. Since the discovery in 1839 of HALON 104 (carbon tetrachloride, $CCl_4$), its usage to fight electrical fires, as well as the other halogen containing family of flame retardants and extinguishing agents, have found wide usage and acceptance within the civilian and military communities, e.g. HALON 1301, ($CF_3Br$) and HALON 1211 ($CF_2BrCl$). The role of the halogen elements (fluorine, chlorine, bromine and iodine), to extinguish the flame has been studied and well documented. The most effective and widely used fire extinguishing agents contain bromine such as the 1301 and 1211 HALONs. These materials thermally decompose in a fire or flame to produce the bromide anion ($Br^-$) which disrupts the chain reactions in the burning process.

It is known that the combustion process of hydrocarbon fuels contained within storage tanks occurs in the vapor state above the liquid hydrocarbon fuel. The flame radiates heat back to the liquid fuel and causes the liquid fuel to become vapor. Between the liquid fuel and the flame, the intense heat causes the vaporized hydrocarbons to fragment producing molecular fragments or hydrocarbon radicals, such as $CH_3$., $CH_2$., $H^+$, etc., which can combine with the atmospheric oxygen in the flame, producing additional heat energy.

The role of the bromide anion ($Br^-$), produced by the thermal decomposition of a HALON, is to disrupt the chain reactions. Possible reaction mechanisms include the hydrogen cation ($H^+$) combining with the bromide anion ($Br^-$) to form HBr which then can react with the $OH^-$ anion to produce water ($H_20$), and the bromide anion ($Br^-$) thereby interrupting the combustion process chain reaction and regenerating the bromide anion ($Br^-$). Bromine containing compounds, particularly the gaseous or low boiling point HALONs, are very effective fire extinguishing agents.

However, due to environmental reasons, (depletion of the upper atmosphere ozone layer) the usage of the HALON class of fire extinguishing agents is presently decreasing, and must continue to decrease. The ban on the manufacture of HALONS begins on Dec. 31, 1994 and the ban on chlorofluorocarbons (CFCs) begins Dec. 31, 1995. There is, therefore, a degree of urgency that an alternate fire extinguishing system be developed that is not dependent upon the HALONS.

When burning of hydrocarbon fuel, the combustion process, can be interrupted or stopped by one or more of the following actions: (1) Remove heat at a greater rate than it is being generated; (2) Prevent fuel from feeding the fire; (3) Lowering the oxygen concentration within the fire by diluting entering air with inert gases, the most outstanding of which is carbon dioxide; and, (4) Interrupt flaming-combustion chain reactions without fuel removal, direct cooling or oxygen dilution.

Since the area under consideration contains the fuel, the prevention of fuel from feeding the fire (Action 2) is not possible. The present invention employs primarily the first and third of these actions by introducing nitrogen, water vapor, and oxides of carbon gases when fire, flame, fireball, heat, and/or an increase in pressure are detected. To further enhance the fire fighting capabilities of the system, the fourth approach, usage of off-the-shelf fire inhibitors, can be used as an adjunct to the on-demand generation of gases and vapors reactions.

The most logical of these actions that could be performed on a military vehicle environment would be to remove heat at a greater rate than it is being generated and to lower the oxygen concentration within the fire area by diluting entering air with inert gases.

The present invention differs from other approaches to achieve these goals by using fast chemical reactions to produce the gases and water vapor when required, e.g., the burning of a propellant or the deflagration (low order detonation) of an explosive. In the present invention, the chemical composition of the propellant for explosive is selected to optimize both, the burning or deflagration rate and their chemical decomposition products. The on-demand nitrogen and water vapor chemical reaction generators of the present invention will simplify existing hardware, eliminate the need for high pressure gas cylinders, and the usage of high detonating rate, primary explosives inside the combat vehicle or aircraft fuel tanks.

The Cartridge Actuated Device (CAD) technology and hardware now available will permit the location of the gas generator for the present invention either, inside the hydrocarbon fuel tank or outside, with the distribution tubing and detection system located inside the fuel tank. CADs, with very slow burning rate chemical formulations, can be used to blanket the liquid hydrocarbon fuel and to increase the percentage of nitrogen gas in the vapor phase before entering the combat zone. A slow rate of production but continuous supply of nitrogen gas is required to replace the volume of the hydrocarbon fuel burned by the aircraft engines.

Non-energetic flame retardant chemicals also can be added to the propellant or explosive formulations, or they can be dispersed into the fuel tank by the expanding gaseous combustion products of the explosive or propellant.

Accordingly, it is an object of the present invention to provide a non-HALON fire extinguishing system causing a decrease in the atmospheric oxygen content, so that burning of hydrocarbon fuels cannot be sustained.

Another object of the present invention is a fire extinguishing system chemically balanced to optimize the production of nitrogen, carbon monoxide and carbon dioxide gases and water vapor.

A further object of the present invention is a gas generating fire extinguishing system for reducing the available atmospheric oxygen in the vicinity of a potential hydrocarbon fuel fire, to such an extent that combustion of the fuel will not be sustained.

An additional object of the present invention is an on-demand, non-HALON, fire extinguishing system.

A still further object of the present invention is an on-demand gas generation system that employs inert gases, water vapor and solid fire inhibitor additives in a fire extinguishing system.

An additional object of the present invention is a fire extinguishing system for hydrocarbon fuel fires that employs an explosive and/or a propellant to engulf the fuel supply in a reduced oxygen atmosphere that will not sustain combustion.

Another object of the present invention is a gas generating system that fills all space in a hydrocarbon fuel tank that is not filled with fuel with a mixture of inert gases, water vapor and flame inhibiting chemical additives.

SUMMARY OF THE INVENTION

According to the present invention, the foregoing and additional objects are attained by providing an on-demand, gas generating system within, contiguous with, or adjacent and in fluid communication with, a hydrocarbon fuel tank of a vehicle. When it is indicated that a hydrocarbon fuel fire is present or imminent, a propellant/explosive mixture within the gas generator is actuated to produce and release a mixture of inert, non-oxidizing, nitrogen, carbon monoxide, carbon dioxide gases, and water vapor that essentially fills any space in the fuel tank not occupied by liquid fuel to reduce any oxygen content in the tank to a level that will not sustain combustion.

The propellant/explosive mixtures employed in the present invention have lower detonation or burning rates than primary military explosives, and undergo a chemical reaction to produce on-demand, water vapor, nitrogen and carbon dioxide gases. The reaction times to produce the gaseous products, are typically milliseconds instead of the microseconds observed for primary, high performance explosives.

Examples of explosive and propellant formulations which are considered suitable for the purposes and objectives of the present invention include; (a) permissibles ("Cardox" and "Hydrox"), (b) binary explosives and hydroxylamine propellants, (c) priming compositions and (d) heterogenous gel slurry and ANFO ammonium nitrate based explosives. Selected explosive formulations of this type are presently used in coal and rock mining, blasting and displacing earth applications. These non-ideal and mining explosive formulations have lower detonation rates and/or high burning rates, and high yield of the water vapor, nitrogen, and carbon dioxide gases.

In addition, flame inhibition chemicals, such as sodium bicarbonate, potassium bicarbonate, potassium carbonate, potassium chloride, and monoammonium phosphate can be employed as additives to these gas generating explosive and propellant charges.

BRIEF DESCRIPTION OF THE DRAWINGS

A more complete appreciation of the invention and many of the attendant advantages thereof will be better understood when considered in connection with the following specific examples and the accompanying drawings wherein.

Figure 1:
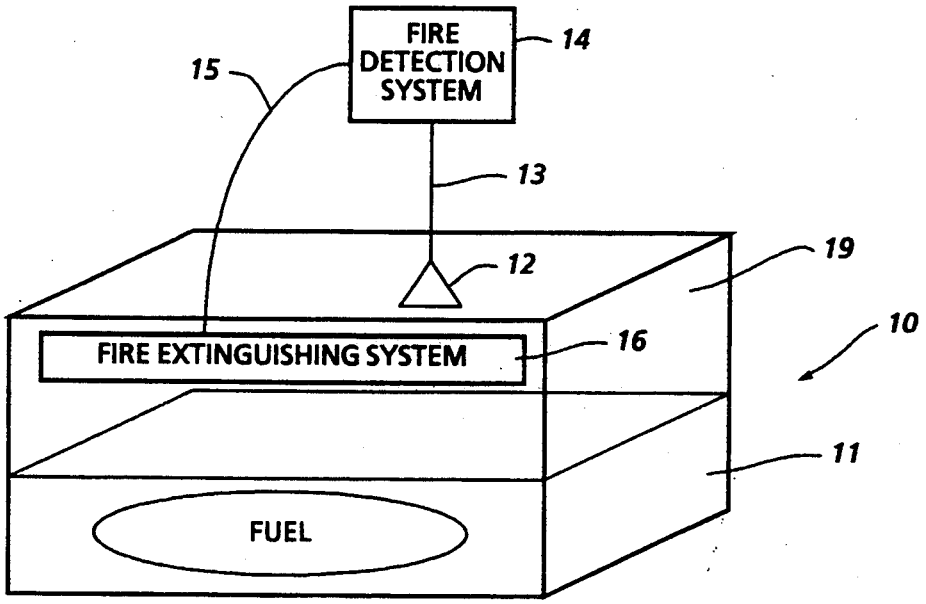
FIG. 1 is a schematic representation of a fuel cell containing a hydrocarbon fuel and provided with a fire extinguishing charge within the fuel cell, according to one aspect of the present invention.

Referring now to the drawings, and more particularly to FIG. 1, which shows a schematic illustration of a fuel cell, designated generally by reference numeral 10 containing a quantity of hydrocarbon fuel therein, as designated by reference numeral 11. Fuel cell 10 is exemplary of any hydrocarbon fuel cell employed as a storage facility for hydrocarbon fuel in a stationary location, or on a moving land, sea or air vehicle. A conventional sensor 12, responsive to either flame, light, pressure, or heat, transfers an electrical signal, through a suitable connection illustrated by line 13, to an actuator forming part of fire detection system 14 to effect release of a fire extinguishing gas generating charge from a gas generating cartridge, contained within fire extinguishing system 16. A suitable electrical connection, illustrated by line 15, is provided between fire detection system actuator 14 and fire extinguishing system 16. Fire extinguishing system 16, in this illustrated embodiment of the invention is disposed within fuel cell 10, and the charge released therefrom reduces the oxygen supply in the fuel cell ullage, designated by reference 19, to a level that will not support combustion to thereby prevent any fire therein or to extinguish any fire that may have already started in fuel cell 10.

Figure 2:
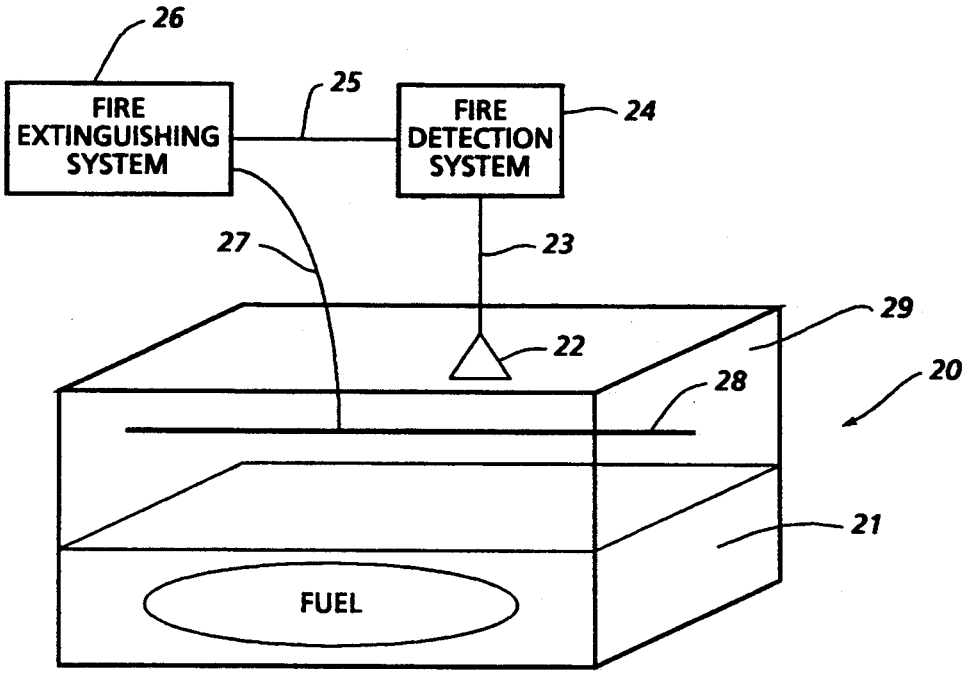
FIG. 2 is a schematic representation of a hydrocarbon fuel cell similar to FIG. 1, and having a fire extinguishing charge disposed exterior of, and in fluid communication with, the fuel cell interior.

Referring now to FIG. 2, a schematic illustration of a fuel cell, similar to that shown in FIG. 1, is designated by reference numeral 20 and contains a quantity of hydrocarbon fuel 21 therein. A sensor 22, responsive to either flame, light, pressure, or heat, is disposed in communication with the interior of fuel cell 20. When the appropriate condition is sensed by sensor 22, an electrical signal is transferred, through electrical connecting line 23, to fire detection system 24. Fire detection system 24 effects actuation of fire extinguishing system 26, through electrical connection 25, to effect release of a fire extinguishing gas generating charge from a gas generating cartridge, contained with fire extinguishing system 26. In this embodiment, the fire extinguishing gas generating charge is disposed exterior of fuel cell 20, and is in fluid communication with the interior of fuel cell 20 through suitable conduit(s), as schematically represented by line 27. The gas generating charge is dispersed within the ullage 29 of fuel cell 20 through conduit 27 and distributing conduit 28 contained within fuel cell 20. When actuated the gas producing charge released from fire extinguishing system 26 is sufficient to replace or reduce the available oxygen in ullage 29 to a level that will not support combustion, as will be further explained hereinafter.

Figure 3:
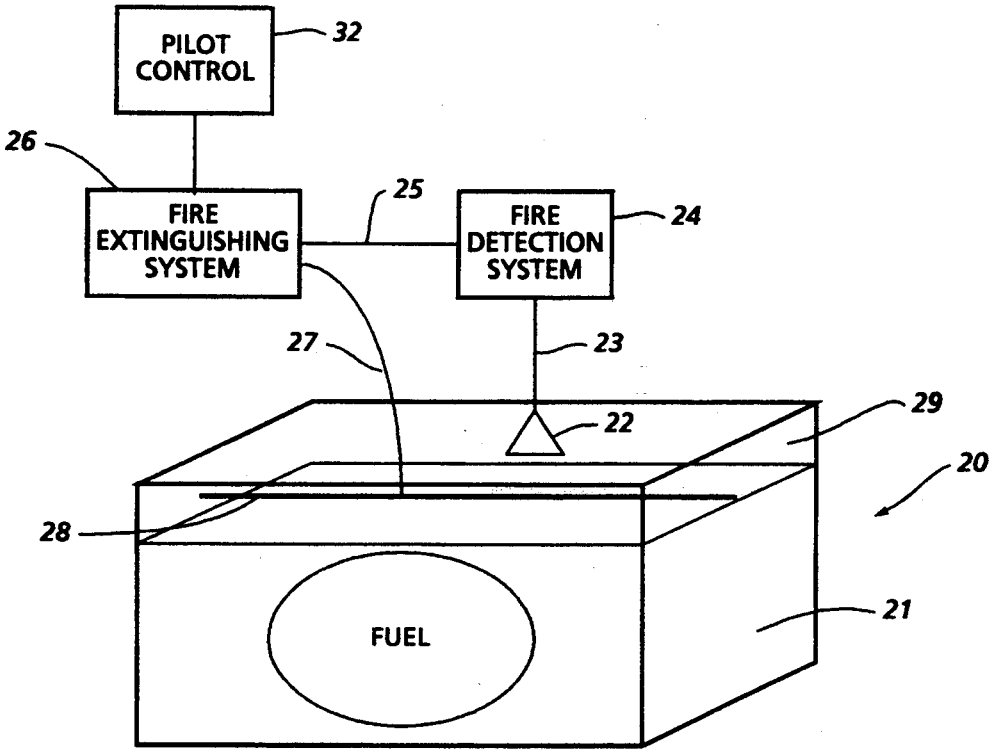
FIG. 3 is a schematic representation of a hydrocarbon fuel cell, similar to FIG. 2 wherein the hydrocarbon fuel cell is disposed within an aircraft, and wherein the fire extinguishing/charge is deployed within the fuel cell before entry of the aircraft into combat.

Referring to FIG. 3, fuel cell 20 and the component parts thereof are identical to those described in reference to FIG. 2 with the exception of an additional structure is shown for activation of fire extinguishing system 26. As shown therein, in addition to fire detection system 24, pilot controls 32 are provided in electrical connection with fire extinguishing system 26 to provide selective release of the fire extinguishing charge from a gas generating cartride, contained therein to replace or inactivate the oxygen contained in ullage 29. Thus, when fuel cell 20 is employed in an aircraft that is anticipating contact or combat with an enemy, the fire extinguishing charge may be released gradually to maintain the available oxygen in ullage 29 at a level that will not support combustion in the event fuel cell 20 is penetrated by a shell fragment of other projectile that otherwise could initiate combustion of fuel 21. Suitable conventional controls are provided with pilot control 32 that permits continuous replacement of the fuel expended in fuel cell 20 with the gas fire extinguishing charge from fire extinguishing system 26.

Figure 4:
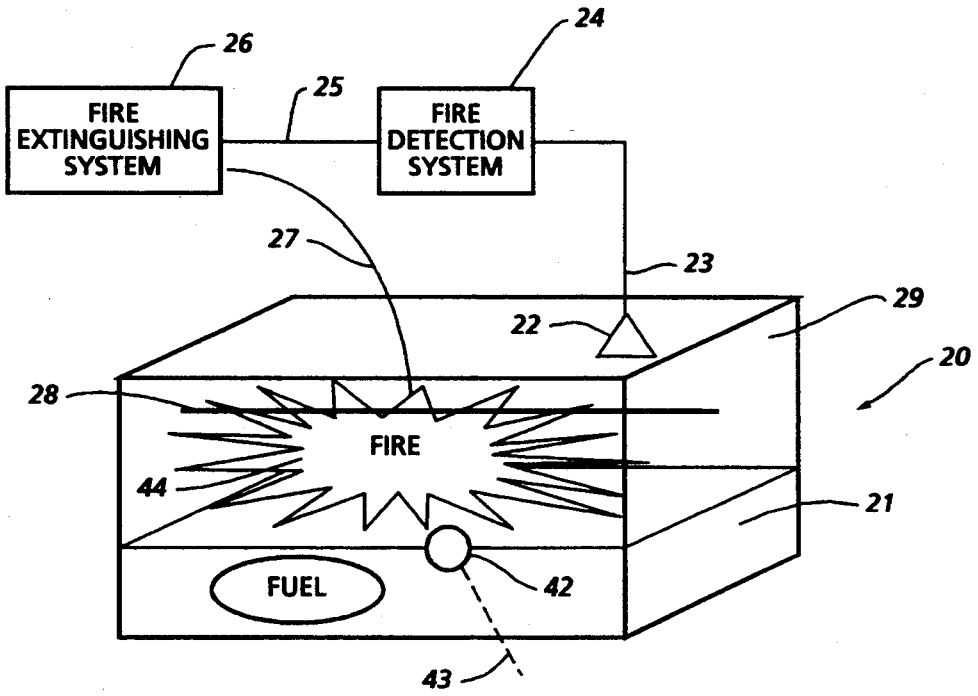
FIG. 4 is a schematic representation of a hydrocarbon fuel cell similar to FIG. 2, wherein the hydrocarbon fuel cell is in a combat vehicle struck by an enemy projectile, and illustrating release of the fire extinguishing charge to dispose of the resulting fuel fire.

Referring to FIG. 4, fuel cell 20 and the component parts thereof are identical to those described in reference to FIG. 2 and illustrates the chain of events happening when a projectile, bullet or shell fragment, penetrates fuel cell 20. As shown therein, a projectile 42 is shown after penetrating fuel cell 20, along path 43, and initiating a fire 44 in ullage 29 therein. Sensor 22, instantaneously acts in response to the fire (through heat, pressure, flash of light, etc.) to cause fire detection system 24 to actuate the gas producing charge in fire extinguishing system 26 and flood the ullage 29 with the fire extinguishing gas and extinguish the fire 44.

Figure 5:
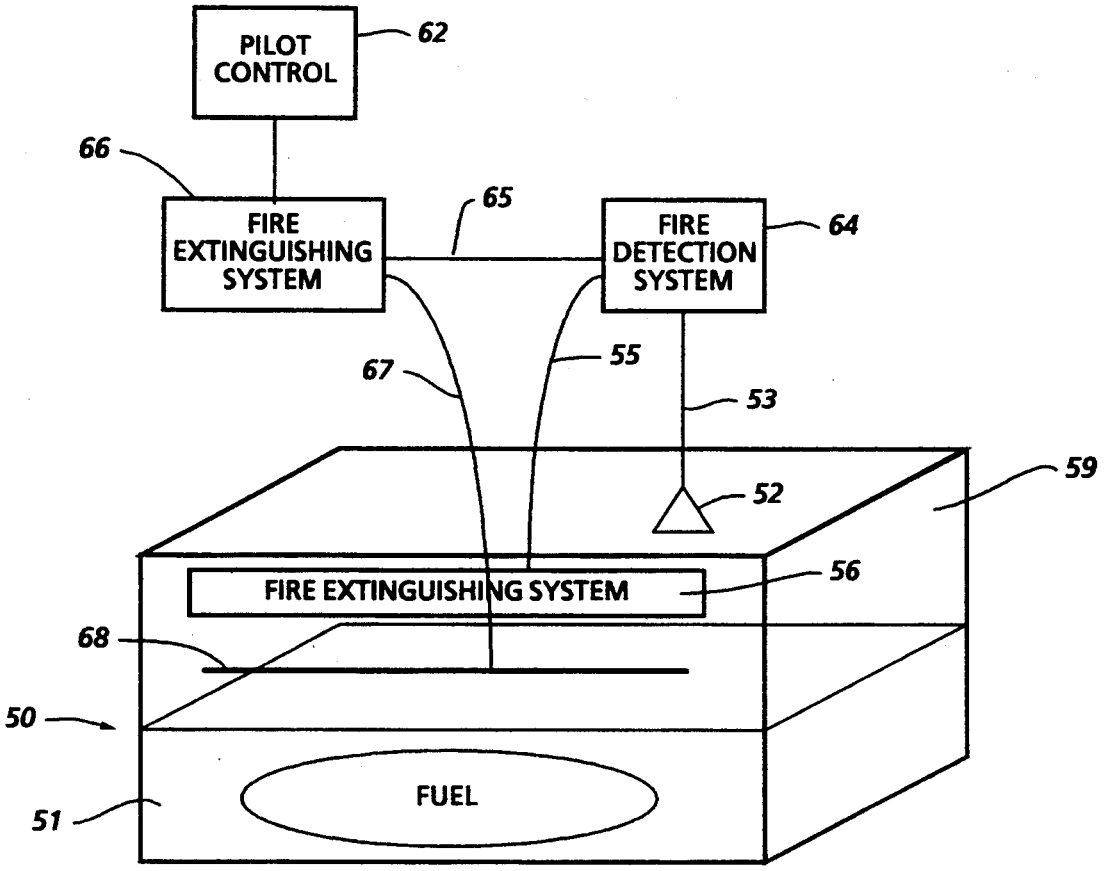
FIG. 5 is schematic illustration of a hydrocarbon fuel cell having a first fire extinguishing system provided within the fuel cell, and a second fire extinguishing system provided exteriorly adjacent, and in fluid communication with, the interior of the fuel cell.

Referring to FIG. 5, an embodiment of the invention is shown combining the fire extinguishing systems described hereinbefore in reference to FIGS. 1 and 2. As shown, fuel cell 50 is employed as a fuel cell in a combat aircraft, and includes a fuel supply 51, a fire sensor 52, an electrical connection between sensor 52 and fire detection system 54, an electrical connection 55 between fire detection system 54 and a first fire extinguishing system 56 containing a fire extinguishing charge and disposed within fuel cell 50. These components perform identical to those described hereinbefore in reference to FIG. 1 in response to any fire in ullage 59 in fuel cell 50. In addition, fuel cell 50 is provided with a second fire extinguishing system 66 disposed exterior of fuel cell 50 and in electrical connection, via electrical connector 65, with fire detection system 54. An electrical connector 63 connects fire extinguishing system 66 to pilot controls 62. A suitable conduit line 67 leads from fire extinguishing system 66 into fuel cell 50, and connects with a distributing conduit 68 disposed therein.

Thus, fuel cell 50 is provided with a double-protection fire extinguishing system with one unit performing identical to that described in reference to FIG. 3 and the other unit performing identical to that described in reference to FIG. 1. Specific examples of suitable gas generating charges for use in each of the illustrations of FIGS. 1–5 are described hereinbelow.

The theoretical chemical reaction, equations (1) through (6), illustrate the examples (a) through (f) of explosives and propellants that are considered operable in practice of the present invention.

(a) "Hydrox", Permissible Explosive $$NaNO_2+NH_4Cl \rightarrow NaCl+N_2\uparrow+2H_2O \qquad \text{Eq. (1)}$$

(b) "Binary Explosives", hydrazine nitrate $$2H_2NNH_3NO_3 \rightarrow 3N_2\uparrow+5H_2O+\tfrac{1}{2}O_2\uparrow \qquad \text{Eq. (2)}$$

(c) "Hydroxylamine Based Propellants", hydroxylamine chloride $$3NH_2OH.HCl \rightarrow 3H_2O+NH_4Cl+2HCl+N_2\uparrow \qquad \text{Eq. (3)}$$

(d) "Priming Compositions", 1,1-(5'-tetrazolyl)-guanyltetrazene hydrate (tetracene)

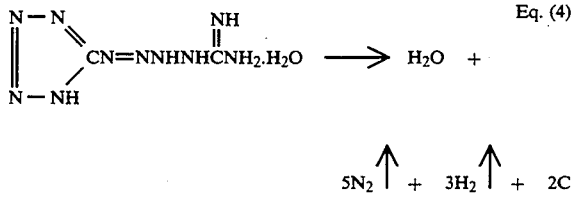

Eq. (4)

(e) "Ammonium Nitrate and Fuel Oil (ANFO) Explosives"

$$25NH_4NO_3+C_8H_{18} \rightarrow 25N_2\uparrow 8CO_2\uparrow+59H_2O \qquad \text{Eq. (5)}$$

(f) "Water Based and Gel Slurry Explosives"

$$H_2O+25NH_4NO_3+40Al+C_8H_{18}+25N_2\uparrow+8CO_2\uparrow+2OAl_2O_3+6OH_2\uparrow \qquad \text{Eq. (6)}$$

The fire extinguishing systems of the present invention are based on these six fundamental chemical reactions, chemically balanced to optimize the production of nitrogen, carbon monoxide and carbon dioxide gases and water vapor. Three of the six fundamental chemical reactions (Equations 1, 3 and 5) can be used as fire extinguishing systems without modification and are balanced to yield the desired nitrogen and carbon dioxide gases, as well as water vapor.

The remaining three fundamental chemical reactions can be modified or combined with other chemical reactions to form acceptable fire extinguishing systems. Without modification, they are either oxidizer rich (oxygen gas, $O_2$), Eq (2) or fuel rich (hydrogen gas $H_2$, and elemental carbon, C), Eq (4) and Eq (6). The generation of oxygen gas, $O_2$, is undesirable because it will contribute to and promote the burning of the hydrocarbon fuels. While hydrogen gas, $H_2$, is a fuel and would compete in the burning process with the hydrocarbon fuel for the atmospheric oxygen, it is an unacceptable combustion product. The flammability (easy ignition) of hydrogen gas, and the intensity of the heat generated by the hydrogen and oxygen reaction are unacceptable. The generation of elemental carbon fuel is less detrimental than the generation of hydrogen. However, the objective is to replace the atmospheric oxygen. The elemental carbon will compete with the hydrocarbon fuel for the available atmospheric oxygen and produce either carbon monoxide gas, CO, or carbon dioxide gas, $CO_2$ which will contribute to the primary fire extinguishing mechanism. The remaining chemical decomposition products, such as sodium chloride (NaCl), ammonium chloride $NH_4Cl$), and alumina ($Al_2O_3$), are solids and do not contribute to the primary mechanism of fire extinguishment, e.g., depriving the hydrocarbon fuel of atmospheric oxygen.

SPECIFIC EXAMPLES

The following specific EXAMPLES of on-demand, non-halon, fire extinguishing systems are based on the six basic chemical reactions identified as equations 1-6 above. The first three specific EXAMPLE fire extinguishing systems are based on the following chemical reactions which are chemically balanced to produce the desired nitrogen and carbon dioxide gases and water vapor:

(a) "Hydrox", Permissible Explosive, Eq. (1)
(b) "Hydroxylamine Based Propellants", hydroxylamine chloride, Eq (3)
(c) "Ammonium Nitrate and Fuel Oil (ANFO) Explosives", Eq. (5).

No modification or changing of the chemical reactants is required for either of these three specific example systems.

EXAMPLE SYSTEM I

"Hydrox", Permissible Explosive $$NaNO_2+NH_4Cl \rightarrow NaCl+N_2\uparrow+2H_2O \qquad \text{Eq. (1)}$$

EXAMPLE SYSTEM II

"Hydroxylamine Based Propellants"

$$3NH_2OH.HCl \rightarrow 3H_2O+NH_4Cl+2HCl+N_2\uparrow \qquad \text{Eq. (3)}$$

EXAMPLE SYSTEM III

"Ammonium Nitrate and Fuel Oil (ANFO) Explosives"

$$25NH_4NO_3+C_8H_{18} \rightarrow 25N_2\uparrow+8CO_2\uparrow+59H_2O \qquad \text{Eq. (5)}$$

The remaining five fire extinguishing specific EXAMPLE SYSTEMS of the present invention are combinations of two or more of the fundamental chemical reactions, equations (1) through (6). They are chemically balanced and optimized for the production or yield of nitrogen and carbon dioxide gases and water vapor. For example, fuel rich systems are optimized by adding either the hydrazine nitrate or the ammonium nitrate oxidizers. The hydrocarbon in the ANFO explosive is replaced by a high nitrogen content fuel, e.g., tetracene. The ammonium nitrate content is increased in Gel Slurry Explosives to increase the production of the nitrogen and carbon dioxide gases and water vapor.

The specific EXAMPLE fire extinguishing systems IV, V and VI (below) combine the hydrazine nitrate explosive and oxidizer, Eq. (2), with fuel rich systems e.g., Eq. (4) or Eq. (6). The excess oxygen, $O_2$, oxidizes the elemental carbon, C, and hydrogen, $H_2$ to enhance the yield of either carbon monoxide, CO, or carbon dioxide gas, $CO_2$, and water vapor, $H_2O$.

EXAMPLE SYSTEM IV

Hydrazine Nitrate and "Priming Compositions" Balanced to Carbon Dioxide, $CO_2$

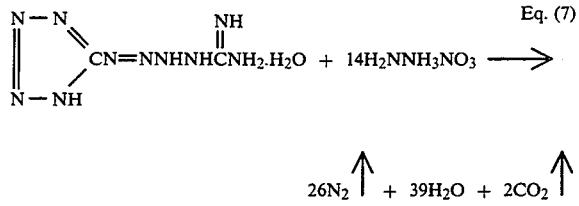

Eq. (7)

EXAMPLE SYSTEM V

Hydrazine Nitrate and "Priming Compositions" Balanced to Carbon Monoxide, CO

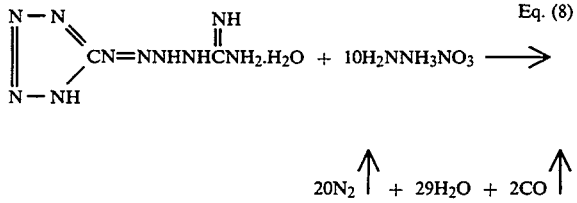

Eq. (8)

EXAMPLE SYSTEM VI

Hydrazine Nitrate and Gel Slurry Explosives $$H_2O+25NH_4NO_3+40Al+C_8H_{18}+12OH_2NNH_3NO_3 \rightarrow 145N_2\uparrow+8CO_2\uparrow+20Al_2O_3+36OH_2O \qquad \text{Eq. (9)}$$

Specific EXAMPLE fire extinguishing systems VII and VIII use the addition of the oxidizer ammonium nitrate, $NH_4NO_3$, to modify fundamental chemical reactions and to optimize the production of the desired gases and water vapor. In specific EXAMPLE systems VII and VIII, the hydrocarbon, $C_8H_{18}$, (diesel fuel or kerosene) in Eq. (5) and Eq. (6) are replaced with a high nitrogen content reactant, e.g. , tetracene, Eq. (4). For example, $NH_4NO_3$ will react with the hydrogen and carbon produced in Eq. (4), as illustrated in specific EXAMPLE fire extinguishing systems VII and VIII. In specific EXAMPLE fire extinguishing system VIII, the high nitrogen content tetracene, Eq. (4) replaces the hydrocarbon fuel, $C_8H_{18}$, in the ANFO explosive system, Eq. (5).

EXAMPLE SYSTEM VII

Ammonium Nitrate and "Priming Composition" Balanced to Carbon Dioxide, $CO_2$

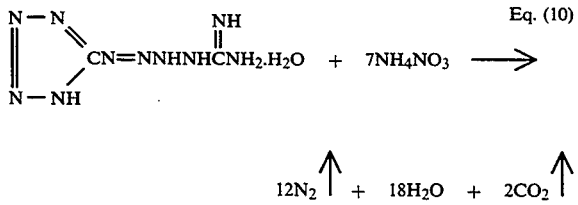

Eq. (10)

EXAMPLE SYSTEM VIII

Ammonium Nitrate and "Priming Composition" Balanced to Carbon Monoxide, CO

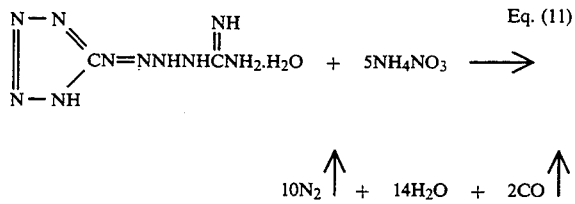

Eq. (11)

In the specific EXAMPLE fire extinguishing system IX, the $NH_4NO_3$ based Gel Slurry Explosive system, Eq. (6), is modified by increasing the quantity (percentage) of the ammonium nitrate oxidizer. In Specific EXAMPLE system VI, the content (percentage) of the ammonium nitrate, $NH_4NO_3$, in the Gel Slurry Explosives, Eq. (6) can be increased to oxidize the hydrogen gas and to enhance the production of nitrogen gas and water vapor.

EXAMPLE SYSTEM

Gel Slurry Explosive with Increased Ammonium Nitrate Content $$H_2O+85NH_4NO_3+40Al+C_8H_{18}+\rightarrow 6ON_2\uparrow+-8CO_2\uparrow+20Al_2O_3+62H_2O \quad \text{Eq. (12)}$$

The inerting requirements to prevent a hydrocarbon fire in a fuel tank is dependent on the threat severity and ignition source and intensity. For example, fragments or bullets of different sizes and velocities, and the HEIT (High Explosive Initiated at the Target) projectile represent ignition sources with very different degrees of intensity.

Ballistic tests have shown that to prevent the ignition of the hydrocarbon fuel, the volume percent of atmospheric oxygen must be reduced from the normal 20.9% to a range of 16 to 6% by volume. The percent reduction required is dependent on the size, velocity, explosive charge, etc., of the penetrating fragment, bullet or projectile.

Tables I through III below summarize the required quantities, moles and weights of reactants for the nine fire extinguishing EXAMPLE systems discussed hereinbefore. Typical conditions and fuel tank volumes are assumed to demonstrate and to compare what the material quantities are to achieve the desired reduction in the atmospheric oxygen content.

The methodology used to calculate the reactant quantities requirements involve the ideal gas law, $PV=nRT$, to calculate the moles of inerting gas required to reduce the percent $O_2$ to 16, 14, 12, 8 and 6%. A volume of 750 liters, which is typical of an aircraft fuel tank, is used in the calculations. Standard temperature (25° C., 298.2K) and pressure (one atmosphere) also are used in the calculations. These determinations can be modified to reflect in-flight temperatures and pressure conditions and other size fuel tanks.

If $P_t=1$ atmosphere, the partial pressure of oxygen, $P_{o2}$, is 0.209 atmospheres. To reduce the partial pressure of oxygen, a volume percentage less that 20.9 in normal air, inerting gases have to be introduced. Table I gives the partial pressures, second column, and moles of gas, third column, of the inerting gases required to achieve the required percentage oxygen, first column, to prevent hydrocarbon ignition.

TABLE I

Moles of Inerting Gas Required to Prevent Ignition

| Percentage $O_2$ | Pressure of Inerting Gas Required, $P_x$ = | Moles of Inerting Gas Required |
|---|---|---|
| 16 | 0.05 | 1.51 |
| 14 | 0.07 | 2.13 |
| 12 | 0.09 | 2.75 |
| 8 | 0.13 | 3.98 |
| 6 | 0.15 | 4.59 |

Table II gives the moles of inerting gases, the total moles of inerting gases, moles of water vapor and total moles produced by each system as represented by equations (1) through (3) and equations (7) through (12). The equations represent the nine specific EXAMPLE fire extinguishing systems discussed hereinabove.

TABLE II

Moles of Gas Produced by EXAMPLE Systems

| EXAMPLE System | Moles of $N_2$ | Moles of $CO_2$ | Moles of CO | Total Moles of Gas | Moles of Water | Total Moles |
|---|---|---|---|---|---|---|
| 1 | 1 | | | 1 | 2 | 3 |
| 2 | 1 | | | 1 | 3 | 4 |
| 3 | 25 | 8 | | 33 | 59 | 92 |
| 4 | 26 | 2 | | 28 | 26 | 54 |
| 5 | 20 | | 2 | 22 | 29 | 51 |
| 6 | 145 | 8 | | 153 | 360 | 513 |
| 7 | 12 | 2 | | 14 | 18 | 32 |
| 8 | 10 | | 2 | 12 | 14 | 26 |
| 9 | 60 | | | 68 | 62 | 130 |

The fire extinguishing system requirements will vary depending on the application, physical arrangement of the fuel tank, operating temperatures and pressures, and the like. If the fire has started, systems which produce large quantities of water vapor, corrosive gases such as hydrochloric acid and solids, such as specific EXAMPLES I, II, VI and IX, will be acceptable. However, if a fire has not started and it is deemed desirable to inert the atmosphere in the tank above the fuel, only those systems which produce nitrogen and/or carbon dioxide gases should be considered, such as specific EXAMPLE systems III, IV, V, VII and VIII.

The effectiveness of the fire extinguishing system depends on many variables such as: (a) the quantity, volume, of nitrogen and carbon dioxide gasses and water vapor produced per unit weight of reactants; (b) the rate of gas production; (c) temperature effects; and (d) production of solids as reaction products.

Different hardware solutions and fire extinguishing systems are required to address all of the requirements for hydrocarbon fuel tank protection. Table III summarizes the weight of reactants required to achieve either eight or fourteen percent, by volume, oxygen in a fuel tank with a 750 liter air space. Table III together with the equations for each specific EXAMPLE system Can be used to compare the relative effectiveness and if a particular system is appropriate for a specific hardware application. For example, if weight is a primary consideration and no consideration is needed for the composition of reaction products, the order that the various specific EXAMPLE systems would be considered is VI, V, VIII, III, VII, IV, I, II and IX.

TABLE III

| Weight of Reactants to Produce 8 and 14% Oxygen | | | | |
|---|---|---|---|---|
| | Weight (grams) of Reactants Required | | | |
| | 14% | | 8% | |
| EXAMPLE System | Total Gas | Gas and Water | Total Gas | Gas and Water |
| 1 | 260.65 | 86.88 | 487.29 | 162.43 |
| 2 | 443.60 | 110.91 | 829.35 | 207.34 |
| 3 | 136.43 | 48.86 | 155.10 | 91.38 |
| 4 | 115.48 | 59.87 | 215.92 | 111.99 |
| 5 | 109.32 | 47.48 | 205.88 | 88.82 |
| 6 | 60.47 | 35.28 | 113.11 | 33.93 |
| 7 | 113.83 | 49.80 | 209.04 | 93.09 |
| 8 | 104.40 | 48.17 | 195.21 | 90.10 |
| 9 | 250.78 | 131.40 | 469.70 | 245.17 |

Although the invention has been described relative to specific embodiments and specific EXAMPLES thereof, it is not so limited. There are numerous variations and modifications of the invention that will be readily apparent to those skilled in the art in the light of the above teachings. Accordingly, the specific EXAMPLES given herein are to be deemed as illustrative only and are not intended to be exhaustive. It is therefore to be understood that, within the scope of the appended claims, the invention may be practiced other than as specifically described herein. Any on-demand, non-halon, fire extinguishing system readable on the appended claims is considered within the scope of this invention.

What is claimed as new and desired to be secured by Letters Patent of the United States is:

1. A fire extinguishing system including: a non-halon fire suppressor charge formulated to produce complete conversion of the starting materials to fire suppressing gases $N_2$, $CO_2$, CO and water vapor in a quantity sufficient to decrease the available atmospheric oxygen in the hydrocarbon fuel tank to such an extent that the burning of hydrocarbon fuel can not be sustained within the tank;

said non-halon fire suppressor charge being selected from the group consisting of:

(A) $H_2NNH_3NO_3$ and 1,1-(5'-tetrazolyl ) -guanyltetrazene hydrate in a molar ratio of from 10:1 to 14:1, and (B) $NH_4NO_3$ and 1,1-(5'-tetrazolyl)-guanyltetrazene hydrate in a molar ratio of from 5:1 to 7:1.

2. The fire extinguishing system of claim 1 including at least one flame retardant chemical added to said non-halon fire suppressor charge for dispersement into said hydrocarbon fuel tank by the expanding gaseous combustion products of said non-halon fire suppressor charge.

3. The fire extinguishing system of claim 1 wherein the non-halon fire suppressor charge is $NH_4NO_3$ and 1,1-(5-tetrazolyl)-guanyltetrazene hydrate in a molar ratio of from 5:1 to 7:1.

4. The fire extinguishing system of claim 3 wherein the non-halon fire suppressor charge is $NH_4NO_3$ and 1,1-(5-tetrazolyl)-guanyltetrazene hydrate in a molar ratio of 7:1.

* * * * *